United States Patent [19]

Gustavsson

[11] 4,144,696

[45] Mar. 20, 1979

[54] SHRINK WRAPPING PROCESS AND APPARATUS

[76] Inventor: Olov E. Gustavsson, Küngalv, Sweden

[21] Appl. No.: 837,237

[22] Filed: Sep. 27, 1977

[30] Foreign Application Priority Data

Oct. 18, 1976 [SE] Sweden ..... 7611564

[51] Int. Cl.[2] ..... B65B 53/02

[52] U.S. Cl. ..... 53/442; 53/557

[58] Field of Search ..... 53/30 S, 33, 184 S, 53/211, 219, 380

[56] References Cited

U.S. PATENT DOCUMENTS

| | | | |
|---|---|---|---|
| 3,624,654 | 12/1971 | Hoffler et al. | 53/30 S |
| 3,863,425 | 2/1975 | Edwards et al. | 53/211 |
| 3,875,723 | 4/1975 | Sundin | 53/184 S |
| 4,051,643 | 10/1977 | Saito | 53/30 S |

FOREIGN PATENT DOCUMENTS

| | | | |
|---|---|---|---|
| 817798 | 8/1959 | United Kingdom | 53/211 |

*Primary Examiner*—Robert Louis Spruill
*Attorney, Agent, or Firm*—Fred Philpitt

[57] ABSTRACT

In a process and apparatus for forming a multi-layer protective envelope around an object that is generally prismatic or cylindric in shape the object while being rotated about a stationary, horizontal axis is wrapped-around with a web of thin, heat-shrinkable and heat-softenable plastic film having a width that exceeds the length of the object, successive portions of said web after having arrived at the periphery of the object and as the object rotates being exposed to a heating radiation while passing a zone extending along the full length of the object and also inwardly over portions of the end surfaces thereof. Layer after layer of said film will thereby shrink to tightly surround the object, including at least the radially outer marginal portions of the ends thereof, and also laminate together into a tough unitary casing.

12 Claims, 3 Drawing Figures

SHRINK WRAPPING PROCESS AND APPARATUS

BACKGROUND OF INVENTION

This invention is concerned with the formation of a protective envelope around an object that is generally prismatic or cylindric in shape, and it relates to a process as well as to an apparatus for forming a multi-layer envelope around the object by winding a web of wrapping material having a width that is greater than the length of the object several times therearound while successively causing the marginal portions of said web to extend inwardly over the radially outer portions of the end surfaces of the object. More specifically, the invention is concerned with such a process and apparatus in which the object to be wrapped is rotated, with its axis of rotation lying in a substantially horizontal and approximately stationary position, while the web of wrapping material is successively supplied to the peripheral surface of the object from suitable dispensing means, whereby space may be saved and the wrapping operation may be facilitated, in particular when large-sized objects are concerned.

Although the objects to be wrapped are said above to be generally prismatic or cylindric in shape, the form of the outer cross sectional contour of them is not critical and may well be elliptical, oval or polygonal. Moreover, it is not critical whether the surfaces of the object are perfectly smooth or whether the ends thereof are fully flat. Tubular objects as well as composite ones, such as bundles, and objects in the form of rolls or coils with or without related cores may be successfully wrapped, if desired.

THE PRIOR ART

A process and apparatus of the kind referred to hereinbefore have previously been utilized, mainly in paper mills, for packaging large rolls of paper. However, in this prior art the wrapping material was, as a rule, a web of uncoated, poor but rather thick paper that was simply wound or coiled around the object and the marginal portions of which were successively folded-in over the end surfaces of the object by means of complex folding mechanisms, which were certainly rather expensive but unreliable in operation and difficult to prevent from frequently tearing the wrapping material, in particular when it was desirable to increase their operational speed. Apart from this, the envelopes obtained in this way could afford only a rather inadequate protection to the wrapped objects against transport damages and wet, because the wrapping paper tore easily in itself and the superposed layers thereof were in no way united in a manner so as to reinforce one another or to form an impervious casing for the object. In addition, the more or less regular folds of the rather thick wrapping paper at the ends of the object made it difficult to attach completing and sealing end pieces of sheet material to the folded wrapping.

For more than a decade heat-shrinkable plastic films, such as of polyethylene and other synthetic resins, have been widely and successfully used in packaging objects of various shapes and sizes. It is also well known that most such shrinkable films may easily be laminated or sintered together in superposed layers by subjecting the completed wrapping to heat, such as by placing the wrapped object in a heated chamber. However, it is believed that such shrinkable plastic films have never before been used in the manner contemplated by this invention.

BRIEF SUMMARY OF INVENTION

This invention has for its object to provide a protective envelope for generally prismatic or cylindric objects, which from case to case can easily be adapted to meet demands as far as thickness and strength are concerned while permitting an optimum utilization of the wrapping material consumed in forming the same, which has an excellent ability to accomodate itself to the shape of the object also at the ends thereof, and which may be formed without the aid of any complex folding mechanisms.

According to the invention this is achieved by using a process of the kind referred to hereinbefore in which the web of wrapping material is a web of a thin plastic film, which by being heated can be imparted adhesive properties and be caused to shrink, and in which successive portions of said film web, after having reached and started to be wound around the object, are exposed to an irradiation of such a nature that the temperature of the wrapping film is thereby considerably increased and its adhering and shrinking properties are released, whereby a successive adherence of or bond between the various film layers will be achieved already during the wrapping of the object, and the marginal portions of the film web, as a result of the shrinking of the film, will be drawn inwardly and tightened over portions of the end surfaces of the object, said irradiation taking place within a substantially stationary zone through which the successive portions of the film web are caused to pass as a result of the rotation of the object, said zone having a limited extent counted in the circumferential direction of the object and extending over the full axial length of the object and radially inwards over portions of the end surfaces thereof.

In other words, the invention is based on the general idea that the web of plastic film is to be treated by exposure to a heating radiation already before the wrapping operation is completed. This means that the capacity of the radiation sources may be kept within moderate limits even when the wrapping speed is rather high, that the total time needed for completing the envelope will be at a minimum, and that, consequently, it will be possible to save both energy and costs.

As already mentioned, the invention is also concerned with an apparatus for carrying out the process, which apparatus features a unique combination of means for supporting and rotating the object to be surrounded by the protective envelope, means for supplying the web of heat-shrinkable and heat-laminable plastic film to the periphery of the object, and means for exposing successive portions of said web to a heating radiation as they are continuously wound around the object.

BRIEF DESCRIPTION OF THE DRAWINGS

For further elucidation of the invention reference will now be had to the accompanying drawings illustrating a favorable form of apparatus for forming a protective envelope around a generally cylindrical object, and in connection with the description thereof the process referred to hereinbefore will also become apparent. In the drawings.

DETAILED DESCRIPTION OF ILLUSTRATED EMBODIMENT

Figure 2:
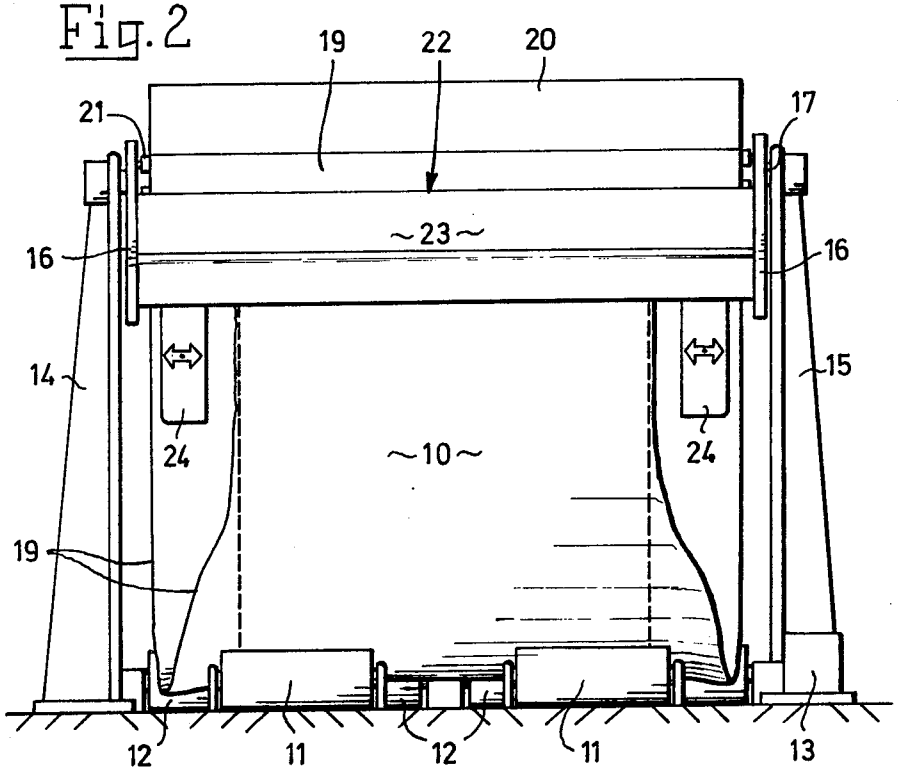
FIG. 2 is a front elevation of the same as seen from the left in FIG. 1.
Figure 1:
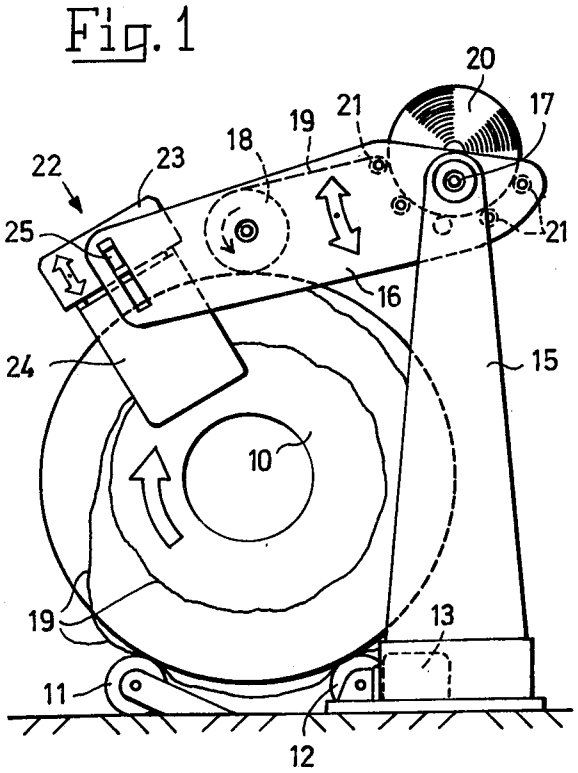
FIG. 1 is a side elevation of the apparatus.

As appears from FIGS. 1 and 2, the apparatus comprises in the first place an appropriate supporting device for the object 10 around which a protective envelope is to be formed. In the case illustrated this supporting device comprises two groups or rows of aligned supporting rollers 11 and 12 which are rotatable about laterally spaced, parallel axes. The foremost group of rollers 11 is vertically adjustable, whereby the object 10 to be wrapped may conveniently be rolled to a position between the two groups of rollers after lowering of the rollers 11 and then be lifted by elevating the latter. The rollers 12 of the rear group are, on the other hand, driven by a motor 13, whereby the lifted object 10 may be caused to rotate at a desirable speed in clockwise direction as indicated by an arrow in FIG. 1.

Now, it should be pointed out that it is rather immaterial, how the supporting device is constituted. The essential thing is that the apparatus comprises some form of equipment or means which is capable of supporting and rotating the object with its axis of rotation lying in a substantially horizontal and generally stationary position while leaving at least the radially outer marginal portions of the end surfaces of the object free. Various well known devices may be used for this purpose, and it is easy to understand that such devices may include driven mandrels, if found desirable, for instance when the object is not even approximately cylindrical.

The apparatus further comprises means for supplying an envelope-forming web of wrapping material to the periphery of the object 10 during the rotation of the object. In the case illustrated, these means include two posts 14 and 15 carrying between them a pivotable cradle 16, which is swingable about coaxial pivots 17 at the upper ends of the posts. The cradle 16 includes a roller 18, the axis of which is parallel to the pivots 17 and also to the axis of rotation of the object 10 or, more specifically in the case illustrated, to the axes of the two groups of supporting rollers 11 and 12. The roller 18 is adapted to ride and roll on the upper side of the object 10 to thereby determine the position of the cradle 16 in relation thereto, and at the same time it serves as a pulley roller for a web 19 of wrapping material that is supplied to the periphery of the object 10 from a supply roll 20 nested in an easily exchangeable and rotatable manner in a kind of receptacle formed by an arcuate series of freely rotatable rollers 21.

The web 19 is a thin plastic film of a kind well known per se, such as one of oriented polyethylene, which by being heated can be imparted adhesive or sticky properties and can be caused to shrink. The film web 19 has a width that is considerably greater than the length of the object 10, and it is supplied to the periphery of the object in such a manner that its two longitudinal marginal portions will come to project at least a short distance outside and respective end surfaces thereof. The length of the roller 18 should be at least equal to the width of the film web 19, and, hence, the length of the cradle 16 as seen in FIG. 2, will be still a little greater. Accordingly, in using the apparatus it will be necessary to at least approximately center the object 10 in relation to the cradle 16 or, more specifically, in relation to the film web 19, because the width of the latter may obviously be reduced to fit objects having a shorter length than the maximum capacity of the apparatus. Such centering may be facilitated by using adjustable guiding means, not shown, for the object and the film web, respectively.

When the foremost portion of the film web 19 is supplied over the roller 18 to the periphery of the object 10 it will be necessary, of course, to see to it that the free, forward end thereof will really follow the object during its rotation so that the web is caused to properly encircle the same. This may be accomplished in many different ways, such as by using some binding agent, adhesive tape, or suitable mechanical clamping or gripping means for attaching the web end to the periphery of the object. As will be readily understood, the freely rotatable roller 18, which is urged downwardly by the cradle 16 and rolls on top of the object 10, will assist in dispensing the film web 19 at the proper rate from the supply roll 20 and in distributing it smoothly over the full length of the object 10.

The cradle 16 also serves as a carrier for a radiating unit generally designated by 22 and located on the side of the roller 18 that is remote from the posts 14, 15. This unit 22 includes a first, substantially horizontally extending member 23 and two other, generally vertically extending members 24 which are suspended from the member 23 and are adjustable in relation thereto in the directions towards and away from the respective end surfaces of the object 10, if the apparatus is to be used for wrapping objects of different lengths. The first member 23 is adjustable relative to the cradle 16 in the radial direction of the object 10 by means of a pair of adjusting mechanisms 25, one at each end. Accordingly, when the apparatus is in use, the roller 18 riding on top of the object 10 and assisting in supporting the cradle 16 will determine the position of the radiating unit 22 relative to the object and thus make it possible to maintain a pre-selected radial distance between the circumference of the object and the lower side of the horizontal unit member 23.

When the apparatus is inoperative, the cradle 16 may be retained in a swung-up quiescent position, in which the unit 22 and the roller 18 are elevated high enough to readily permit insertion and removal of the objects 10 to be wrapped. This may be effected by means, not shown, connecting the cradle to either one of or both the two posts 14, 15, and, if the cradle is heavy to raise, such means may also be designed to assist in raising it.

Figure 3:
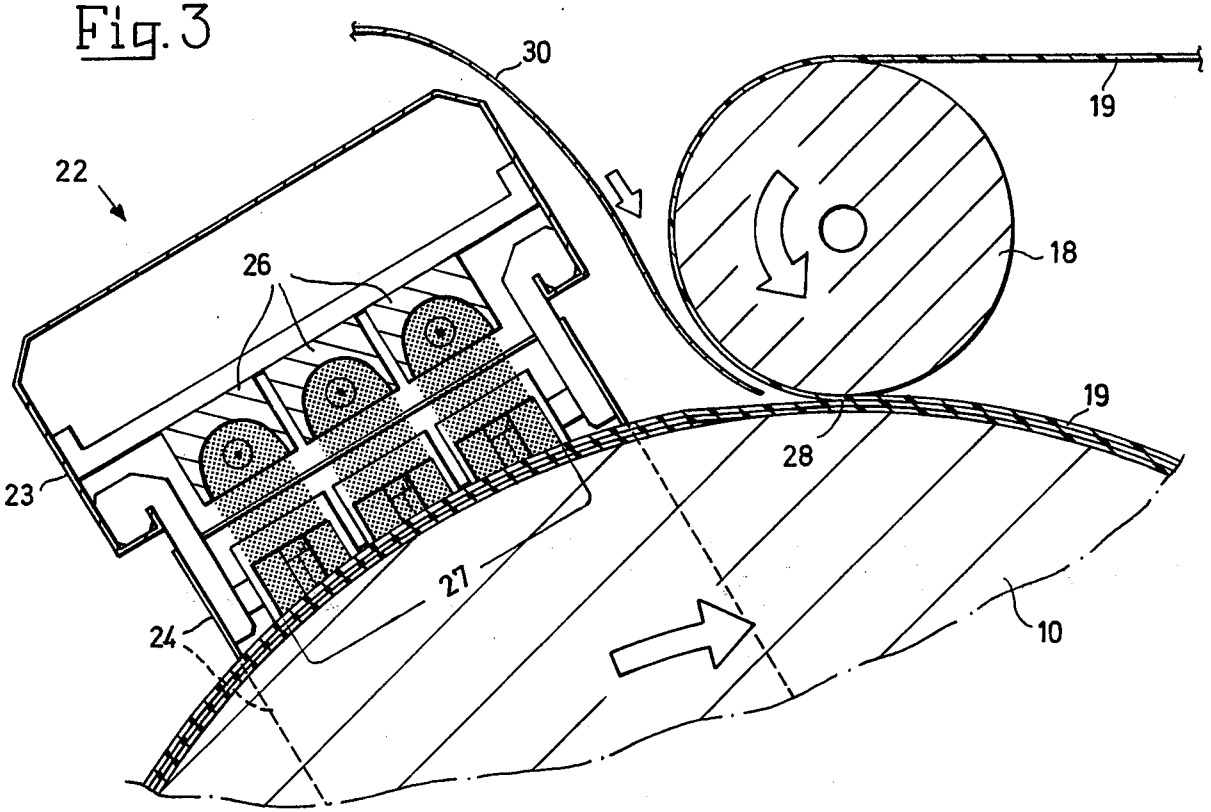
FIG. 3 is a fragmentary sectional elevation on an enlarged scale taken along a vertical center line in FIG. 2.

From FIG. 3 it more closely appears how the film web 19 is supplied over the roller 18 to the periphery of the object 10. It also appears from this figure that the member 23 of the radiating unit 22 houses at least one group of radiation sources 26 directed towards the object. In the case illustrated the sources 26 are shown as being of a kind well knwon per se comprising linear reflectors having tubular, electrically energized emitters of infrared radiation mounted therein. However, although such radiation sources will give a very satisfactory result, the specific design and kind of excitation of the sources 26 are not critical, and there are many other useful types of infrared radiation emitters with and without reflectors available on the market which may well be substituted for those illustrated. The important thing is that the radiation sources 26 are capable of emitting in a direction towards the object 10 a radiation of such character and power that the temperature of the film web 19 surrounding the object will be considerably increased as successive portions of the web pass under and inside the straddling radiating unit 22, the heating of the web having, of course, for its purpose to cause the newly added film layers to adhere to and laminate together with the underlying film layer so as to form a tough and unitary multi-layer skin and at the same time to shrink in a manner to tightly embrace the object.

A similar arrangement of radiation sources is provided in each of the two vertically extending unit members 24 but in them the radiation sources are mounted and adapted to irradiate portions of the end surfaces of the object 10 instead of a portion of the circumferential surface thereof. Accordingly, the inwardly directed radiation from the unit members 24 will heat the marginal portions of the film web 19, which as a result of the position of the unit 22 near the top of the object already under the influence of gravity will show a tendency to hang down over the end surfaces of the object, and cause them to shrink in a manner to make them cling to or stretch tightly over at least the radially outer marginal portions of the end surfaces of the object.

The radiation sources in the members 23 and 24 of the radiating unit 22 are thus operative to irradiate successive portions of the film web 19 as the latter reach and pass a generally stationary, rather narrow belt-like area or zone 27 that extends axially over the circumferential surface of the object 10 and also at least a short distance radially inwardly over the two end surfaces thereof. It should be readily understood that if the apparatus is made adjustable to wrap objects differing considerably from each other in length and/or diameter, it may be advisable to electrically connect the radiation sources 26 in rather small groups, particularly at the extremeties of the members 23 and 24, so that certain groups may be left inoperative when smaller objects are treated. On the other hand, the radiation sources should be arranged in such a manner within the members of the radiating unit 22 that the film web 19 over its entire width will be exposed to a substantially uniform radiation. Also, it should be understood that the radiation sources must be connected to the power supply through suitable, manually or automatically operated switches in order to be energized only when needed.

As will also appear from FIG. 3, the radiation zone 27 is located only a short distance in front of the place 28, where the film web 19 supplied over the roller 18 first arrives at the object 10. This gives the advantage that the recently irradiated layer of layers of the film web will still be hot when being subsequently covered by a fresh portion of the film web, whereby the latter will be caused to immediately adhere, at least in a preparatory manner, to its substrate, against which it is firmly pressed by the roller 18. Among other things this will result in a convenient fixation of the outer end portion of the film web when the supply of film to the object is interrupted by cutting the web at the time when the wrapping operation is to be finished.

The process carried out in the apparatus described is as follows: After the object 10 has been placed on the supporting device 11, 12, the forward end of the film web 19 pulled down over the roller 18 is attached to the periphery of the object, such as by adhesive tape. Then the cradle 16 is swung down to become supported by the roller 18 riding on top of the object, and the motor 13 is started so that the object is caused to rotate and to pull along the film web 19. When the forward end of the latter has just arrived under the roller 18 again, and the first wrapping layer thus embraces the object 10, the radiation sources 26 in the radiating unit 22 are caused to be energized. From now on, the successive portions of the film web 19 wound around the object 10 will be caused to shrink and to laminate or sinter together, layer upon layer, as long as desired until a protective envelope of sufficient thickness and strength has been formed. When no further layer of fresh film is needed, the web 19 is cut off, preferably somewhere between the supply roll 20 and the roller 18, and the rotation of the object 10 is continued for one or more further revolutions in order to complete the envelope before the radiation sources 26 in the radiating unit 22 are deenergized, the cradle 16 is swung up to its quiescent position, and the wrapped object is removed from the apparatus.

Since the film web 19 is preferably a very thin one, at least three layers thereof are commonly needed to form the protective envelope around the object. On the other hand, since the film web is successively heated and thereby caused to shrink and laminate or sinter together layer upon layer, the energy consumption of the apparatus is very moderate as compared with that of known shrink-wrapping plants in which the wrapping and shrinking operations are carried out separately. Also the resulting envelope will be neater and smoother, particularly at the ends of the object, thereby making it easier to attach end pieces to the envelope, if needed.

Whenever desirable, a reinforcement of the multilayer envelope may be provided by adding an insert strip 30, for instance of paper, cardboard, fabric, or net, and embedding it between any two layers of the film web. Preferably such a reinforcement insert should then have a width that corresponds only to the length of the object. However, if the film web 19 is a transparent one, the insert 30 may also for instance be a label of any desires size smaller than the circumferential surface of the object, which label will then be protected by the superposed film layer or layers.

I claim:

1. In the process for forming a protecting plastic envelope around an object that is at least generally prismatic or cylindric and which has two ends and an elongated exterior surface portion extending between said two ends, said process comprising the steps of:

(A) supporting the object in a manner to permit rotation thereof with the axis of its elongated exterior surface portion lying in a substantially horizontal and approximately stationary position and with at least the radially outermost portions of its two ends free, (B) causing the object thus supported to rotate about said axis, while (C) winding a web of plastic film around said elongated exterior portion a plurality of times while the object is rotating so as to cover said elongated portion with a plurality of superposed layers of plastic film, and (D) applying heat to effect shrinkage of said plastic, the improvement which comprises in combination (1) applying a web of plastic film that is thin and which has a width greater than the length of said elongated exterior surface portion so that the plastic film will extend beyond the ends of said object, (2) said plastic film being of the type which by being heated can be imparted adhesive properties and be caused to shrink, (3) subjecting the full axial length of each of said plurality of layers of plastic film to heat radiation as each plastic film layer is applied to said elongated exterior surface portion, each such successive heat application extending across the entire elongated exterior or surface portion, (4) also heat radiating the portions of said web of plastic that extend beyond said two ends so that these portions of the plastic web will shrink inwardly toward the axis of the elongated exterior surface portion, (5) the amount of heat radiation applied to each plastic film layer in accordance with step (3) being regulated to increase the temperature of each successively applied plastic film layer to an extent that its adhering and shrinking properties are released whereby adherence of each succeeding film layer to the next will be achieved during wrapping of the object, and the end portions of the film web, as a result of the shrinking of the film, will be drawn inwardly and tightened over portions of the end surfaces of the object.

2. A process as claimed in claim 1 wherein said successive portions of the film web supplied to the object are exposed to the temperature-increasing irradiation within an area of the circumferential surface of the object in which they are just about to be covered by a subsequently supplied portion of the film web.

3. A process as claimed in claim 1 wherein said successive portions of the plastic film web supplied to the object are exposed to the temperature-increasing irradiation only when they are covering a temporarily upwardly facing area of the circumferential surface of the object.

4. A process as claimed in claim 1 wherein said film web is supplied to the object in a transversely flattened condition and if firmly pressed only against the circumferential surface of the object.

5. A process as claimed in claim 1 wherein the object is wrapped with at least three layers of said film web.

6. A process as claimed in claim 1 wherein a separate insert strip is embedded between any two layers of said film web wound around the object.

7. An apparatus for forming a protective envelope around an object that is at least generally prismatic or cylindric comprising in combination:

(A) means for supporting the object and rotating the same with its axis lying in a substantially horizontal and approximately stationary position and with at least the radially outermost portions of its two end surfaces free, (B) means for successively supplying to the periphery of the supported and rotating object a web of wrapping material having a width greater than the length of the object in a manner to cause the marginal portions of said web to project beyond the respective ends of the object and for successively winding said web around the object in layer upon layer, and (C) radiating means operative to expose successive portions of the web of wrapping material supplied to the object to an irradiation of such a nature that the temperature of the web is considerably increased after its arrival at the object, said radiating means comprising (I) a first, horizontally extending radiating member which is formed and arranged to irradiate an axially extending belt-like area of the circumferential surface of the object, and (II) two other generally vertically extending radiating members which are formed and arranged to irradiate limited areas of each one of the two end surfaces of the object, (D) said means for supplying the web to the object and winding it therearound including means for pressing the central portion of said web against an area of the circumferential surface of the object that is adjacent and extends substantially parallel to said belt-like area irradiated by said first radiating member.

8. An apparatus according to claim 7 wherein said first member of the radiating means is radially adjustable in relation to the object, and wherein at least one of said two other members of the radiating means is axially adjustable in relation to the object.

9. An apparatus according to claim 8 wherein said two other members of the radiating means are supported by said first member thereof.

10. An apparatus according to claim 8 wherein said radiating means are supported by a cradle, and wherein said cradle is supported by a roller bearing against the circumferential surface of the object, whereby the position of said radiating means relative to the object will be determined.

11. An apparatus according to claim 10 wherein said roller is adapted to ride on a first upwardly facing area of the circumferential surface of the object, and wherein said first member of the radiating means is supported by the cradle in a manner to irradiate a second, generally upwardly facing area of the circumferential surface of the object.

12. An apparatus according to claim 11 wherein said roller serves as a pulley roller, over which the web of wrapping material is supplied to the object.

* * * * *